United States Patent [19]

Lombard

[11] 4,043,300

[45] Aug. 23, 1977

[54] APPARATUS FOR BALANCING THE FLOW OF TWO AGENTS, CAPABLE OF REACTING TOGETHER TO PROVIDE ENERGY, TO AN ENERGY GENERATOR

[75] Inventor: Claude Lombard, Le Chesnay, France

[73] Assignees: Regie Nationale des Usines Renault, Boulogne-Billancourt; Automobiles Peugeot, Paris, both of France

[21] Appl. No.: 546,893

[22] Filed: Feb. 4, 1975

[30] Foreign Application Priority Data

Feb. 8, 1974 France ..... 74.04384

[51] Int. Cl.[2] ..... F02B 3/00

[52] U.S. Cl. ..... 123/32 EA; 123/32 EE; 60/276; 324/33; 137/88; 137/101.19

[58] Field of Search ..... 123/32 EE, 32 EA; 60/276; 324/33; 137/88, 98, 100, 101.19, 101.21, 111

[56] References Cited

U.S. PATENT DOCUMENTS

| | | | |
|---|---|---|---|
| 3,229,077 | 1/1966 | Gross | 137/101.19 |
| 3,474,815 | 10/1969 | Beahm et al. | 137/101.19 |
| 3,474,815 | 10/1969 | Beahm et al. | 137/101.19 |
| 3,498,900 | 3/1970 | Banks et al. | 324/33 |
| 3,634,754 | 1/1972 | Lovelock et al. | 324/33 |
| 3,638,272 | 8/1972 | Vissers et al. | 324/33 |
| 3,796,119 | 3/1974 | Knapp | 123/32 EA |
| 3,817,225 | 6/1974 | Priegel | 123/32 EA |
| 3,823,373 | 7/1974 | Hanson et al. | 324/33 |
| 3,827,237 | 8/1974 | Linder et al. | 60/276 |
| 3,831,563 | 8/1974 | Brittian et al. | 123/32 EA |
| 3,832,848 | 9/1974 | Scholl | 60/276 |
| 3,935,851 | 2/1976 | Wright et al. | 123/32 EA |

OTHER PUBLICATIONS

Plant & Contr.; Ken Jackson; May '71, pp. 102–103.

*Primary Examiner*—Carroll B. Dority, Jr.
*Assistant Examiner*—Paul Devinsky

[57] ABSTRACT

A device for metering the flow of two fluids, such as the flow of liquid fluid and air to an internal combustion engine, includes a respective duct for each of the two fluids, an ionic flow meter in each of the two ducts, a valve controlling the flow of one of the fluids through its duct and circuitry comparing the flow rates measured by the ionic flow meters and controlling the valve accordingly so as to maintain a desired ratio between the two flow rates.

25 Claims, 1 Drawing Figure

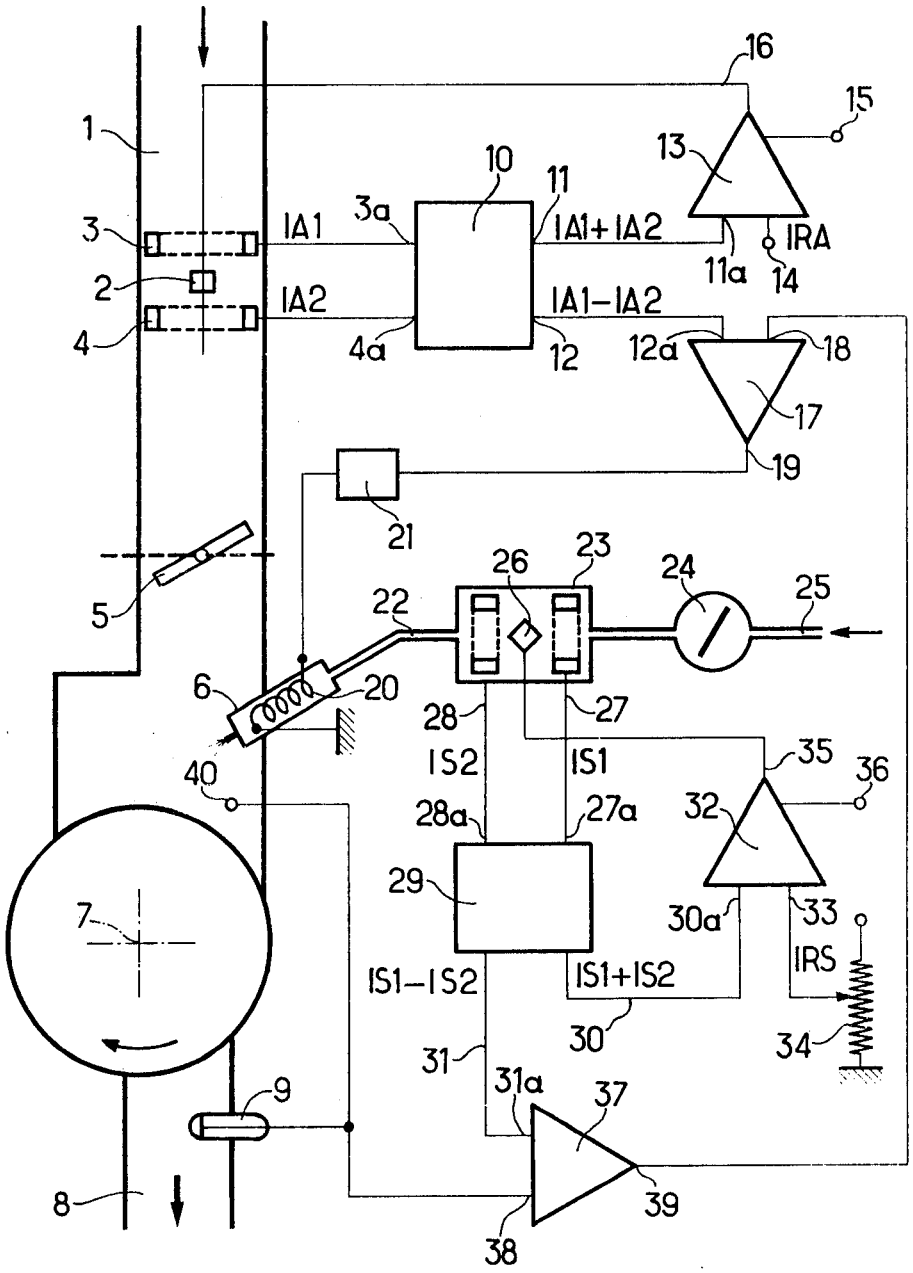
16
15
1
13
10
11
3
IA1
3a
IA1+IA2
IRA
2
11a
14
IA2
IA1−IA2
4
4a
12
12a
18
17
19
21
5
26
23
24
25
22
6
20
28
27
IS2
IS1
35
36
40
28a
27a
32
29
7
30a
33
IS1−IS2
IS1+IS2
IRS
30
34
31
31a
37
9
8
39
38

APPARATUS FOR BALANCING THE FLOW OF TWO AGENTS, CAPABLE OF REACTING TOGETHER TO PROVIDE ENERGY, TO AN ENERGY GENERATOR

The invention relates to a device for balancing the mass flow of two agents, capable of reacting together to provide energy, to an energy generator adapted to generate energy by the interaction of said agents.

Important examples of such energy generators are internal and external combustion engines, where one such agent is air and the other is fuel, for example, a hydrocarbon fuel, in liquid or gaseous form, which is burnt with the air to produce heat.

Another example of such an energy generator is a fuel cell, where the energy generated by the interaction of the agents is in the form of electricity.

In operation of such energy generators, it is important to ensure an accurate balance between the inlet flow rates of two agents, whether it is desired to produce heat, for example, in heat engines, or electricity, for example, in fuel cells. The problem has become more urgent owing to anti-pollution legislation and the simultaneous need to economise on fuels. Solutions to this problem have long been proposed, but most of them are based on a priori adjustment which can only be a poor compromise, since it cannot take full account of variations in the input or operating parameters.

In some known devices, a probe is inserted in the path of the products of the reaction between the agents in the energy generator (e.g. in the path of the exhaust gases in the case of an internal combustion engine) so as to analyse the products, and the relative feed flow rates of the agents are adjusted according to the analysis made. These probes, however, raise problems which have not yet all been solved, and usually act too slowly owing to the mechanical, thermal or chemical protection which they require.

Ionic devices are also known for measuring the mass flow rate of air fed into a heat engine, but the known ionic devices are usually associated with complex computers operating in accordance with predetermined programs.

The basic features of ionic measurement of a flow rate of gas have been described inter alia in the report of the meeting of the ACADEMIE DES SCIENCES FRANCAISE on June 12, 1944, page 929. Liquid flowmeters are also known which use electric means for directly measuring the flow rate.

It is an object of the present invention to provide a simple device for rapidly metering the ratio between the mass flows of two agents, capable of reacting together to provide energy to an energy generator adapted to generate energy by the interaction of said agents.

According to the invention, there is provided a device for controlling the ratio between the flow rates, of two agents to means for generating energy by the interaction of said agents, the device comprising means providing respective ducts for the flow of said agents, a respective flow rate detector in each said duct, means for comparing the flow rates sensed by said flow rate detectors, adjusting means for adjusting the flow rate of one of said agents through the respective duct, said adjusting means being under the control of said means for comparing the flow rates, whereby the last mentioned can control said adjusting means so as to maintain a predetermined ratio between the flow rates of the two agents.

In a preferred embodiment where ionic flowmeters are used, certain precautions are of course taken during use, for example, with regard to the shape and nature of the electrodes and the presence of a safety ring, and as a result of these precautions, readings proportional to the mass flow can be obtained.

The comparison of flow rates can be effected in a simple, very rapid manner, either by analog or numerical means. In the preferred embodiment, said adjusting means comprises at least one valve for metering one of said agents, or may comprise valves for metering both said agents if allowance has to be made for a third reference value, for example, the power to be delivered by the energy generator.

A particularly useful application of the invention is to internal combustion engines in which said agents are a) air and b) natural or synthetic hydrocarbons or hydrogen. In the case of these engines, additional corrections can easily be introduced for cold starting (during which only part of the fuel is evaporated), or for high-speed operation where power is often required at the expense of extra consumption and pollution.

Another correction can be introduced by a probe disposed in the exhaust-gas path so as to take account, for example, of the fuel characteristics due inter alia to selective evaporation in the fuel storage tank. Furthermore, a very simple manual or automatic correction can be made if there is a changeover in fuel, for example, from petrol to methanol. To this end it is simply necessary to modify the proportionality ratio and the correction for cold starting, when the changeover is made to the new fuel.

An embodiment of the invention is described below with reference to the single FIGURE of the accompanying drawing, which is a schematic diagram of the device in combination with an internal combustion engine.

In the drawing, reference 1 denotes an air inlet duct for an internal combustion engine, said duct 1 extending from an air intake (not shown). In travelling along this duct in the direction shown by the arrow, the air passes electrodes 2, 3 and 4 forming an ionic cell for differentially measuring the air flow rate, 2 being an electrode for generating ions at a high potential and 3 and 4 being the receiving electrodes.

After passing the ionic measuring cell, the air stream travels through an inlet throttle valve 5, and passes a fuel inlet valve 6. The engine proper is diagrammatically denoted by a circle described about a centre of rotation 7. On leaving the engine, the exhaust gases travel through an exhaust pipe 8 containing an analysing probe 9 for analysing the composition of the exhaust gases.

In the arrangement to be described, the amount of air admitted to the internal combustion engine is regulated by the air throttle valve 5 to obtain the desired engine power. The throttle valve is usually connected to the vehicle accelerator (not shown). In the present case, therefore, the amount of petrol admitted is controlled in dependence on the air flow rate, by the device according to the invention.

Electric currents IA1 and IA2 collected by electrodes 3 and 4 are fed to an electronic integrating amplifier 10 having two inputs 3*a* and 4*a* respectively. An amplified current proportional to the sum of the input currents IA1 and IA2 is provided at the first output 11 of amplifier 10, whereas an amplified current proportional to the difference between the same two input currents is provided at the second output 12 of amplifier 10. The difference, therefore, is used to measure the flow rate of air entering via duct 1.

Output 11 of amplifier 10 is connected to an input 11*a* of an amplifier 13 having another input 14 receiving a stabilised reference current IRA. Amplifier 13 is connected at 15 to a high-voltage source (not shown), and its output 16 is connected to electrode 2.

Output 12 of amplifier 10 is connected to input 12*a* of an amplifier 17 whose other input 18 is adapted to receive information corresponding to the amount of fuel sued. Output 19 of amplifier 17 is connected to the winding 20 of the metering valve 6 via a modulation device 21 which is needed only when valve 6 operates discontinuously and the supply is via pulses having a variable frequency and duration.

Valve 6 is supplied with fuel by a supply duct 22 incorporating of an ionic cell 23 for measuring the fuel flow rate, the input to cell 23 being connected to a fuel pump 24, the fuel being fed to pump 24 via an inlet duct 25.

Measuring cell 23, which is similar to the first measuring cell in duct 1, has an ion-emitting electrode 26 and two receiving electrodes 27, 28. The currents IS1 IS2 collected by electrodes 27, 28 respectively are fed to an electronic integrating amplifier 29 having two inputs 27*a*, 28*a*. The two outputs of amplifier 29 are denoted by 30 and 31. The amplified current available at output 30 is proportional to the sum of the input currents IS1 and IS2, whereas the amplified current available at output 31 is proportional to the difference between them, the difference being used to measure the mass flow of fuel. Output 30 is connected to input 30*a* of an amplifier 32 whose other input 33 receives a stabilised reference current IRS coming from an adjusting means which in the present case is a potentiometer 34. Output 35 of amplifier 32 is connected to the emitting electrode 26 of cell 23. Amplifier 32 is supplied at 36 by a high-voltage source (not shown) which if required may be the same as the source supplying amplifier 13 at point 15.

Output 31 of amplifier 29, which is used for measuring the petrol flow rate, is connected to input 31*a* of an amplifier 37 having another input 38 receiving data from the probe 9 for analysing the exhaust gases. Input 38 may also receive data from a probe 40 for measuring the air feed temperature or the wall temperature of the feed duct. Consequently, a signal corresponding to the adjusted petrol flow rate is collected at the output 39 of amplifier 37, which is connected to input 18 of amplifier 17, where the air-fuel comparison is made.

The cells for measuring the air or fuel flow rate and the amplifiers connected downstream thereof are adjusted so that, if the flow rate is zero, no current appears at outputs 12, 31 of amplifiers 10, 29 respectively. During the inoperative state, therefore, the ions emitted by the central electrode 2 or 26 are equally distributed between the two receiving electrodes in each measuring cell. As soon as a fluid begins to flow, the ions preferentially travel towards the receiving electrode which is downstream of the ion source, and a current appears at each of the outputs 12 and 31. On the other hand, the comparing amplifiers 13 and 32 each ensure that the sum of the currents received by the receiving electrodes of the respective ionic cell is constant, since their first input 11*a* or 30*a* respectively receives a current proportional to the sum of the currents connected by each flow rate measuring cell, whereas their second input 14 or 33 respectively receives a reference value; consequently amplifiers 13 and 32 regulate the high voltage applied to the ion sources 2, 26 respectively. Accordingly, the currents collected at outputs 12, 31 have values corresponding to the mass flow rate of air or of fuel passing the measuring cells.

The mass flow-rate vaues, after being corrected by probes 9, 40 or an adjusting device 34 which, when the fuel is changed is adjusted to give a new setting corresponding to the change in fuel, are compared in the comparing amplifier 17 which, acting via modulator 21 if required, controls the operation of valve 6. Valve 6 can operate continuously or discontinuously, in accordance with known methods.

A number of valves 6 corresponding to different inlet ducts may be used with a single air flow meter cell, or alternatively the number of cells may be equal to the number of valves.

In another embodiment (not shown in the drawing), the analog amplifiers 10, 29, 37, 17 are entirely or partly replaced by equivalent devices, including current-to-frequency converters for deriving from currents IA1, IA2, IS1, IS2 or from their respective differences, signals of corresponding frequencies, and further including substracting counters for comparing the frequencies corresponding to IA1 and IA2 and for comparing the frequencies corresponding to IS1 and IS2 and further including adding counters for ensuring that the frequency sums corresponding to IA1 + IA2 and IS1 + IS2 have given values. The resulting numerical assemblies also comprise an output converter, inter alia of the variable square-wave kind, adpated to act via amplifiers 13 and 32 on the high voltage applied to the ion-emitting electrodes 2, 36 respectively. The current-to-frequency converters may in turn be replaced by coders using a binary or other system with numerical processing, or in accordance with a "stochastic" method of calculation. Although the last-mentioned embodiment is more complex than that using analog amplifiers, the more complex embodiment may in certain cases be more adaptable to other systems used with an energy generator.

In another variant, valve 6, which may if required be combined with pump 24, is an ion pump. Ions pumps have recently been described in the technical literature. Their low pressure may be sufficient for a metering device operating as a carburetter. The delivery height of the ionic pump is electrically controlled so as to act either directly or in back pressure with respect to pump 24.

Alternatively, valve 6 may be of the piezoelectric kind or of any other known kind without departing from the invention, provided that it is used for metering.

The device according to the invention is also applicable to devices for generating heat independently of any other driving energy, or to STIRLING external-combustion engines. It also applies to sources of electrical energy such as fuel cells. The device has the advantage that it is not necessary to wait till the end of the combustion process before acting on the metering operation, since the flow rates are compared at the inlet, contrary to what happens if a single outlet probe is used.

If one of the combustion-supporting agents is pulverulent and in suspension in a fluid, it may be necessary to add to the aforementioned device a reference cell in which the fluid only (not the combustion-supporting agent) circulates.

I claim:

1. A device for controlling the ratio between the flow rates of two agents capable of reacting together to provide energy to means for generating energy by the interaction of said agents, the device comprising:

means providing respective ducts for the flow of said agents, a differential type detector in each said duct comprising a central ion generating electrode and two collecting electrodes symmetrically disposed with respect to the ion source, means for processing the signals of each flow rate detector, means for supplying current to said flow rate detectors, means for regulating the current supplying means, means for comparing the flow rates sensed by said flow rate detectors.

adjusting means for adjusting the flow rate of one of said agents through the respective duct, said adjusting means being connected to the output of the comparing means, temperature sensing means for sensing the temperature of at least one said agent, and means connecting said temperature sensing means with said comparing means for varying said ratio according to the temperature sensed.

2. The device of claim 1, wherein said processing means comprises an integrating amplifier having two inputs each of which is connected to a collecting electrode of said detector, and two outputs, the first of which produces a current proportional to the sum of its input currents and is connected to said current supplying means, and the second of which produces a current proportional to the difference of its input currents and is connected to said comparing means.

3. The device of claim 1, wherein the current supplying means comprises amplifiers supplied by a high voltage source and having an input connected to a stabilized reference current source.

4. The device of claim 1 comprising a potentiometer connecting one of said current supplying means to the stabilized reference current source.

5. The device of claim 1, wherein said adjusting means includes an ion pump, and electrical means for varying the delivery height of said ion pump so that the pump can either act directly or produce a back-pressure.

6. A device for controlling the ratio between the flow rates of two agents capable of reacting together to provide energy to means for generating energy by the interaction of said agents, the device comprising:

means providing respective ducts for the flow of said agents, an ionic flow rate detector in each said duct wherein each flow rate detector comprises a differential type detector including a central ion generating electrode and two collecting electrodes symmetrically disposed with respect to the ion generating electrode, means for processing output signals from each flow rate detector, means for supplying current to said flow rate detectors, means for regulating the current supplying means, means for comparing the flow rates sensed by said flow rate detectors, and adjusting means for adjusting the flow rate of one of said agents through the respective duct, said adjusting means being connected to the output of the comparing means.

7. The device of claim 1 wherein the processing means comprises an integrating amplifier having two inputs each of which is connected to a collecting electrode of said detector, and two outputs, the first of which produces a current proportional to the sum of its input currents and is connected to said current supplying means, and the second of which produces a current proportional to the difference of its input currents and is connected to said comparing means.

8. The device of claim 6 wherein the current supplying means comprises an amplifier supplied by a high voltage source and having an input connected to a stabilized reference current source.

9. The device of claim 8 comprising a potentiometer connecting one of said current supplying means to the stabilized reference current source.

10. The device of claim 6 wherein said adjusting means includes an ion pump, and electrical means for varying the delivery height of said ion pump so that the pump can either act directly or produce a back-pressure.

11. A device for controlling the ratio between the flow rates of two agents capable of reacting together to provide energy to means for generating energy by the interaction of said agents, the device comprising:

means providing respective ducts for the flow of said agents a differential type detector in each said duct comprising a central ion generating electrode and two collecting electrodes symmetrically disposed with respect to the ion source, means for processing the signals of each flow rate detector, means for supplying current to said flow rate detectors, means for regulating the current supplying means, means for comparing the flow rates sensed by said flow rate detectors, adjusting means for adjusting the flow rate of one of said agents through the respective duct, said adjusting means being connected to the output of the comparing means, temperature sensing means for sensing the temperature of at least one said agent, means connecting said temperature sensing means with said comparing means for varying the ratio of the flow rates according to the temperature sensed, an analyzing probe for analyzing the gaseous products of the reaction of said agents, and means connecting said analyzing probe with said comparing means for varying said ratio according to the results of the analysis.

12. The device of claim 11, wherein said processing means comprises an integrating amplifier having two inputs each of which is connected to a collecting electrode of said detector, and two outputs, the first of which produces a current proportional to the sum of its input currents and is connected to said current supplying means, and the second of which produces a current proportional to the difference of its input currents and is connected to said comparing means.

13. The device of claim 11, wherein the current supplying means comprises an amplifier supplied by a high voltage source and having an input connected to a stabilized reference current source.

14. The device of claim 11 comprising a potentiometer connecting one of said current supplying means to the stabilized reference current source.

15. The device of claim 11, wherein said adjusting means includes an ion pump, and electrical means for varying the delivery height of said ion pump so that the pump can either act directly or produce a back-pressure.

16. The device of claim 11, wherein said energy generating means is an internal combustion engine, and wherein one of said agents is air, the flow rate of which is compared with the flow rate of the other agent.

17. The device of claim 11, wherein said energy generating means is an external combustion engine, and wherein one of said agents is air, the flow rate of which is compared with the flow rate of the other agent.

18. The device of claim 16, wherein said other agent contains hydrogen in pure state.

19. The device of claim 16, wherein said other agent contains hydrogen in hydrocarbons.

20. The device in claim 16, wherein said energy generating means is a fuel cell.

21. A device for controlling the ratio between the flow rates of two agents capable of reacting together to provide energy to means for generating energy by the interaction of said agents, the device comprising:

means providing respective ducts for the flow of said agents, a differential type detector in each said duct comprising a central ion generating electrode and two collecting electrodes symmetrically disposed with respect to the ion source, means for supplying current to said flow rate detectors, a current-to-frequency converter connected to each said collecting electrode, an adding counter for each flow rate detector for ensuring that the sums of the frequencies of said respective converters have given values, an output converter connected to the output of each said adding counter and controlling the current supplying means, a subtracting counter for each flow rate detector for comparing the frequencies of the respective said current-to-frequency converters, a comparing means for comparing the flow rates sensed by said flow rate detectors and having two inputs each of which is connected to the output of a corresponding subtracting counter, adjusting means for adjusting the flow rate of one of said agents through the respective duct, said adjusting means being connected to the output of said comparing means, temperature sensing means for sensing the temperature of at least one said agent, means connecting said temperature sensing means with said comparing means for varying the ratio of the flow rates according to the temperature sensed, an analyzing probe for analyzing the gaseous products of the reaction of said agents, and means for connecting said analyzing probe with said comparing means for varying said ratio according to the results of the analysis.

22. The device of claim 21, wherein said processing means comprises an integrating amplifier having two inputs each of which is connected to a collecting electrode of said detector, and two outputs, the first of which produces a current proportional to the sum of its input currents and is connected to said current supplying means, and the second of which produces a current proportional to the difference of its input currents and is connected to said comparing means.

23. The device of claim 21, wherein the current supplying means comprises an amplifier supplied by a high voltage source and having an input connected to a stabilized reference current source.

24. The device of claim 21, comprising a potentiometer connecting one of said current supplying means to the stabilized reference current source.

25. The device of claim 21, wherein said adjusting means includes an ion pump, and electrical means for varying the delivery height of said ion pump so that the pump can either act directly or produce a back-pressure.

* * * * *